United States Patent [19]

Jakobi

[11] 4,151,859

[45] May 1, 1979

[54] THROTTLE SHAFT FOR THE CONTROLLED DISCHARGE OF DAMMED-UP WATER

[75] Inventor: Walter Jakobi, St. Ingbert-Rohrbach, Fed. Rep. of Germany

[73] Assignee: Oswald Schulze GmbH & Co. KG., Gladbeck, Fed. Rep. of Germany

[21] Appl. No.: 784,674

[22] Filed: Apr. 5, 1977

[30] Foreign Application Priority Data

Apr. 6, 1976 [DE] Fed. Rep. of Germany ..... 2614731

[51] Int. Cl. ..... F16k 21/18; F16k 31/28

[52] U.S. Cl. ..... 137/390; 137/423; 405/103

[58] Field of Search ..... 137/389, 390, 391, 423, 137/101.27; 405/39, 96, 103, 104

[56] References Cited

U.S. PATENT DOCUMENTS

| | | | |
|---|---|---|---|
| 356,448 | 1/1887 | Clark | 137/390 |
| 361,456 | 4/1887 | Shepherd | 137/390 |
| 518,776 | 4/1894 | Campbell et al. | 137/390 |
| 810,390 | 1/1906 | Bode | 137/390 |
| 947,325 | 1/1910 | Callaway | 405/104 |
| 1,175,379 | 3/1916 | Reisert | 137/389 |
| 1,610,283 | 12/1926 | Hill | 137/390 |
| 2,290,246 | 7/1942 | Murphy | 137/423 |
| 2,556,771 | 6/1951 | Moore | 137/389 |
| 2,882,919 | 4/1959 | Brown | 137/423 |

*Primary Examiner*—Martin P. Schwadron
*Assistant Examiner*—G. L. Walton
*Attorney, Agent, or Firm*—Karl F. Ross

[57] ABSTRACT

The throttle shaft for the controlled discharge of dammed-up water, especially for the controlled flow of sewage and waste water to sewage-processing units, comprises a housing formed with an inlet and an outlet for a float-controlled throttle flap at the inlet regulating the flow of water into the housing in response to the water level therein. According to the disclosure, the housing is provided with a throttle channel for the water which communicates with the outlet and is provided with an adjustable shutter shiftable between a fully closed and a fully open position to vary the flow cross section of this channel or passage.

6 Claims, 4 Drawing Figures

THROTTLE SHAFT FOR THE CONTROLLED DISCHARGE OF DAMMED-UP WATER

FIELD OF THE INVENTION

The present invention relates to a throttle shaft for the controlled discharge or release of dammed-up water, especially waste water or sewage. More particularly, the invention relates to a throttle shaft for this purpose which has a water inlet, a water outlet and a throttle flap for the water inlet which is controlled by a float in dependence upon the operating water level established within the throttle shaft housing.

BACKGROUND OF THE INVENTION

It is known to provide throttle shafts of the aforedescribed construction to permit the controlled discharge of pent-up water, e.g. sewage or waste water, to downstream units for the processing or handling of the sewage. In practice, therefore, it is often required to provide increased flows of dammed-up water, albeit at constant rates, to apparatus downstream of the store of water. Such downstream apparatus can include, for example, for a waste-water-handling installation, a clarifier, a pumping station, the main drainage ditch, or the like.

When a float-controlled throttle flap is used at the respective downstream unit it is not possible with one and the same throttle shaft to feed the different quantities of water which may be needed at the different units.

Thus, since the clarifier, pumping station drainage system and like elements may have different maximum flow requirements $Q_{max}$, these different units cannot be fed with the same throttle shaft.

However, each such unit must be operated at a respective substantially constant flow rate and nevertheless should not have its $Q_{max}$ exceeded. Hence it is common practice to provide a respective throttle shaft at the inlet to each unit, the throttle shafts being differently constructed or of different dimensions in accordance with the respective $Q_{max}$. This, of course, is disadvantageous since the throttle shafts must be designed in each instance for the desired $Q_{max}$, or a large number of preconstructed throttle shafts must be available in a variety of capacities to accommodate different requirements of the flow rate $Q_{max}$.

OBJECTS OF THE INVENTION

It is, therefore, the principal object of the present invention to provide a throttle shaft for the controlled discharge of dammed-up water, especially waste water, whose operating water level can be varied to provide different values of $Q_{max}$ as required.

It is another object of the invention to provide a throttling shaft for the purpose described which reduces the need for multiple units of different dimensions and nevertheless permits one and the same throttle shaft to supply systems having different $Q_{max}$ requirements.

Another object of this invention is to provide a throttle shaft of improved design which obviates disadvantages of conventional throttle shafts.

SUMMARY OF THE INVENTION

These objects and others which will become apparent hereinafter are attained, in accordance with the present invention, in a throttle shaft which comprises a housing having an inlet, a float-controlled throttle flap in the inlet for regulating the flow of water into the housing in dependence upon the water level therein, and an outlet for discharge of the water from the housing at a throttled rate.

The invention resides in providing a flow path between the throttle flap and the outlet as a throttle chamber communicating with the outlet and having a flow cross section which is variable by an adjustable shutter between fully closed and fully open conditions.

The invention is based upon my discovery that, for a float-controlled flap throttle of the aforedescribed type, it is possible to vary the $Q_{max}$ by effectively varying the operating water level within the housing by the aforementioned shutter in the throttle channel ahead of the outlet. In other words an additional control is provided within the throttle shaft to enable the system to operate with different operating water levels. It is also possible, by opening or closing the shutter, to establish an operating water level in the throttle chamber which controls the opening or closing of the throttle flap because its float rises or sinks in dependence upon the operating water level and thus closes or opens the throttle flap. Sufficient water supply is thereby guaranteed.

Should the operating water level be reduced to a relatively small $Q_{max}$, the shutter is actuated to correspondingly reduce the cross section of the outlet so that the outflow is reduced, the water level rises and the throttle flap closes at the operating water level. Conversely, when a relatively large $Q_{max}$ is to be delivered, the shutter is opened and substantially more water drains without the operating water level causing the closing of the throttle flap. It is possible to select a value anywhere between the minimum value of $Q_{max}$ (substantially closed shutter) and the maximum value of $Q_{max}$ by simply varying the shutter opening. In addition, the shutter can be completely closed so that water discharge is terminated and, when the operating water level rises, entry of water into the throttle shaft is likewise terminated by the throttle flap.

According to another feature of the invention, the throttle chamber is funnel-shaped, i.e. convergent in the direction of water flow to the outlet and the shutter is provided substantially at the apex of the funnel or convergence, i.e. at the most constricted point along the flow channel. This construction has been found to give optimum flow characteristics. The throttle chamber according to the invention is formed with side walls of such height that the maximum water level in the throttle chamber closes the throttle flap which is actuated by a float disposed upstream of these walls. This ensures that the throttle flap is controllable between its open and closed positions by the float.

According to still another feature of the invention, the throttle chamber is provided with a central discharge channel with a shape such that the water has an increased head as it flows outwardly and thus prevents the trapping of deposits upstream of the shutter or downstream thereof.

The shutter can be of the slit-gate type, i.e. comprising a pair of gate members lying in a common vertical plane perpendicular to the flow channel and displaceable horizontally toward and away from one another. These gates or blades are disposed downstream or upstream of the water passage. The blades can be a height equal to that of the side walls of the throttle chamber to permit the maximum operating water level to be attained.

Advantageously, the throttle chamber and the discharge chamber have the shutter disposed between them. The transition surfaces in the flow direction can all be inclined downwardly, thereby increasing the flow velocity and preventing accumulations of deposits. This construction, moreover, permits the shutter to be somewhat lower than the operating water level and enables the inlet to be disposed above the outlet.

The system of the present invention is highly advantageous as compared to earlier throttle shafts, in that it permits the same unit, without change in dimensions, to be used at the inlets to clarifier tanks, pumping stations or drainage systems, each requiring different values of $Q_{max}$, by simply adjusting the respective shutter accordingly. In addition, the system of the present invention has the advantage that it is simple, reliable and free from a tendency to collect waste or other materials which might otherwise deposit.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
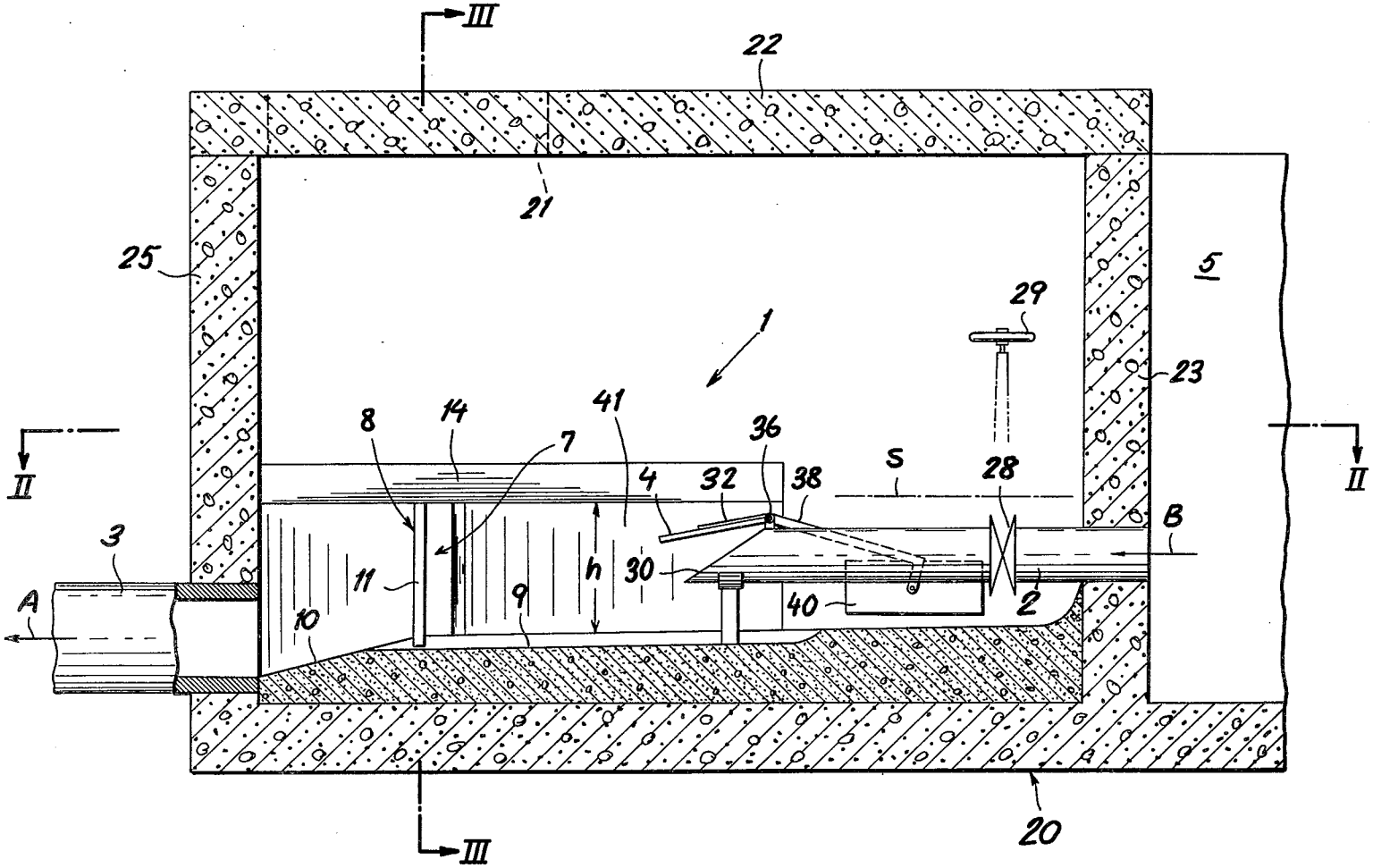
FIG. 1 is a vertical section taken generally along the line I—I of FIG. 2.

In the drawing I have shown a throttle shaft which comprises a housing 20 which can be formed from concrete and has a manhole for access represented at 21 in the cover plate 22 of this housing. The housing 20 also comprises an upstream end wall 23 which can be formed as part of a receptacle 5 for the dammed-up water, the wall 23 being extended laterally at 24 as part of the wall of this receptacle. Opposite the end wall 23, the housing 20 is formed with a downstream end wall 25 and the housing is completed by a pair of lateral walls 26 and 27.

The throttle shaft 1 comprises a water inlet 2, e.g. a pipe, extending into the wall 23 and communicating with the waste water in tank 5, the inlet pipe 2 being provided with a valve 28 which can be operated by a handwheel diagrammatically shown at 29 rising above the maximum water level S within this housing.

Figure 2:
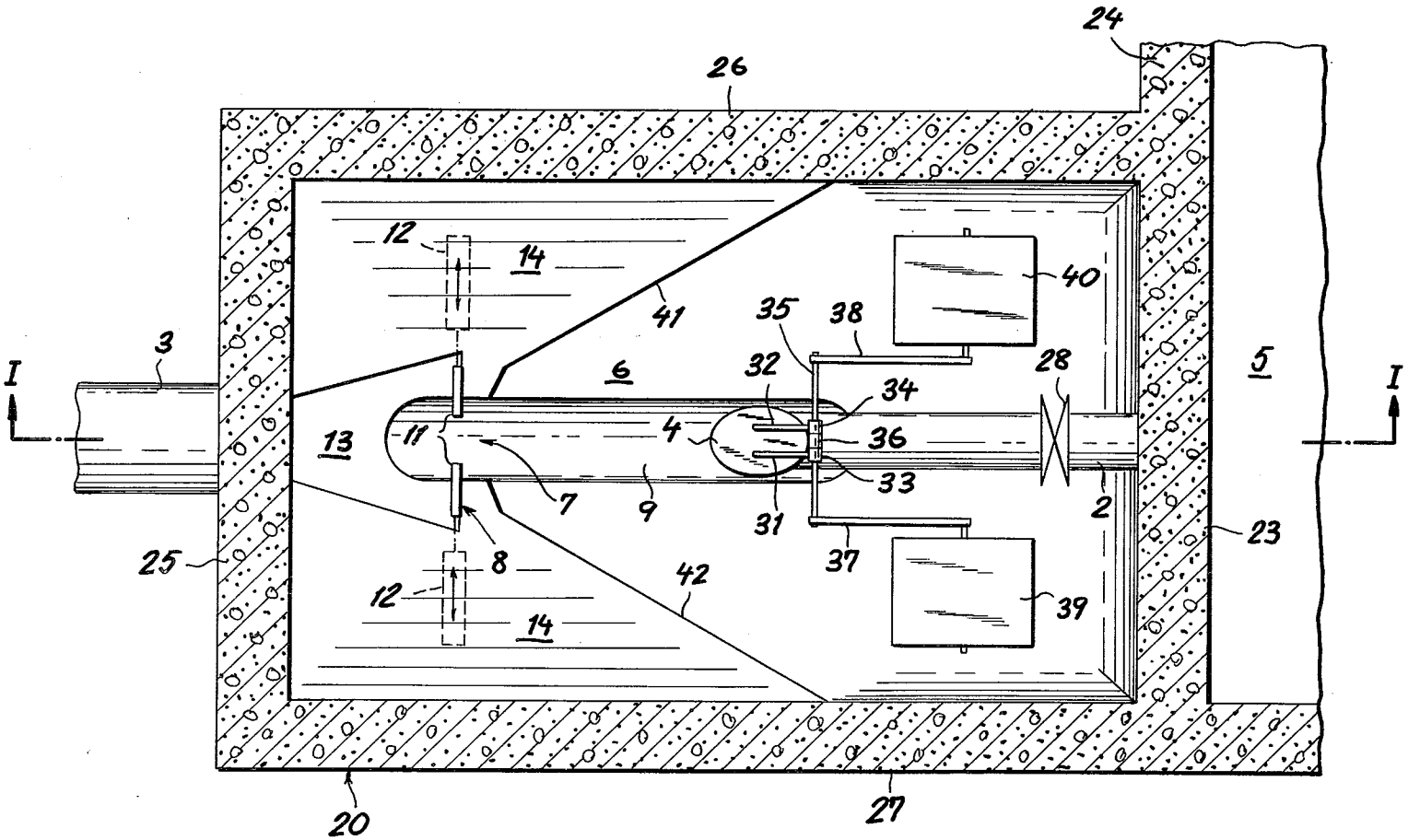
FIG. 2 is a diagrammatic section taken along the line II—II of FIG. 1.
Figure 3:
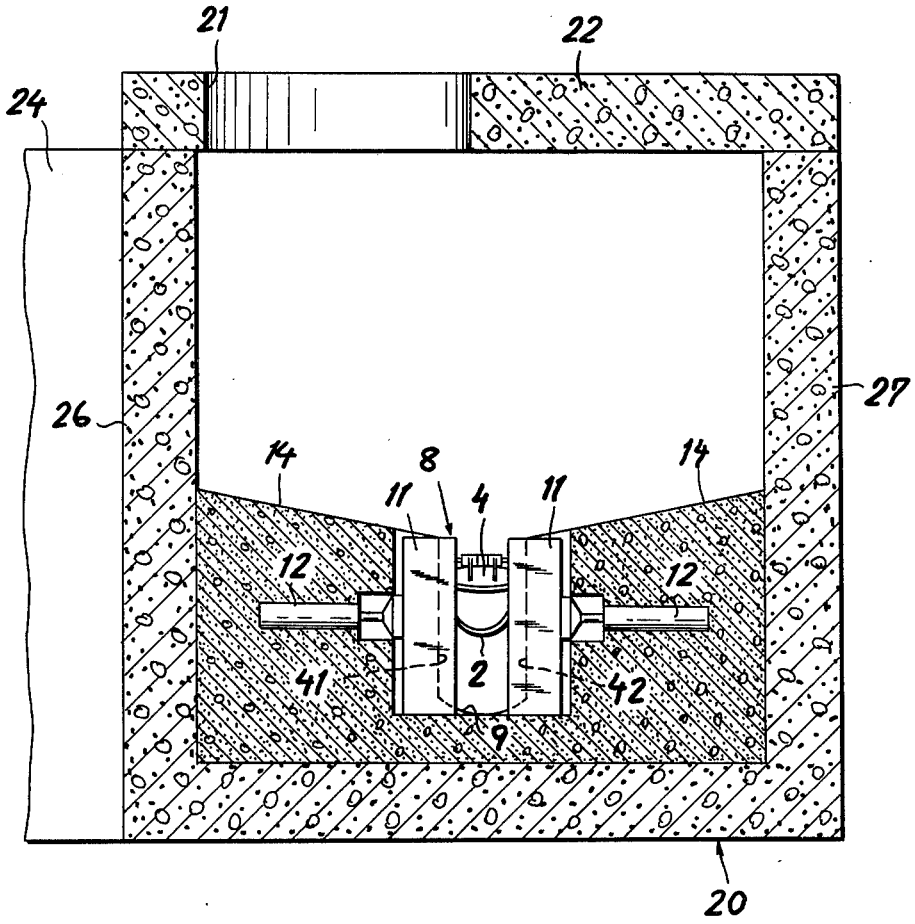
FIG. 3 is a section taken along the line III—III of FIG. 1.

The end 30 of the inlet pipe 2 lies in a plane inclined to the axis of the pipe and can be variably open and closed by a throttle flap 4. The throttle flap 4 is an elliptical disk (FIG. 2) fixed by ribs 31 and 32 to bushings 33 and 34 which are connected by setscrews (not shown) to a shaft 35 journaled at 36 at the top of the pipe 2. The shaft 35 projects laterally beyond the sides of the pipe and at its ends is connected to a pair of arms 37 and 38, each of which carries a float 39, 40.

Hence, the throttle flap 4 is controlled by the operating water level S established within the shaft 1.

Between the throttle flap 4 and the water outlet 3, formed in the wall 25 of the housing 20, there is provided a throttle chamber 6 having a waterflow passage 7 which is juxtaposed with the outlet 3, the cross section of this passage 7 being variable by an adjustable shutter between a fully open and a fully closed condition.

The chamber 6 is defined between walls 41 and 42 and converges in the flow direction, i.e. is funnel-shaped toward the outlet.

At the apex of this convergence within the waterflow passage 7, the shutter 8 is provided. The side walls 41, 42 have a height h which determines the maximum water level S in the throttle chamber at which the throttle flap 4 closes completely. For the sake of illustration, the water level S has been shown to be higher than the level at which the floats 39 and 40 are disposed. Normally the floats rise to the water level S and close the flap 4 which has been illustrated in an open position in the drawing.

The throttle chamber 6 is formed with a central discharge channel or trough 9 which is sloped downwardly in the flow direction (arrows A and B). Downstream of the shutter 8 and between the shutter and the outlet pipe 3, the throttle shaft 1 is formed with a runoff surface 10 which converges toward the outlet 3 and has a still greater slope or drop.

The shutter 8 is formed as a slit shutter and comprises a pair of shutter plates, gates or blades 11 which are oriented vertically and are shiftable horizontally by, for example, the hydraulic or pneumatic cylinder 12 to open or close the cross section of the passage 7. Naturally, the shutter plates 11 can also be positioned manually if desired.

Of course the shutter 8 can also be formed with a vertical plate or curtain which is displaced downwardly to close against the bottom of the shaft 1.

The shutter 8 is disposed behind or ahead of the outlet 7 and has the height h of the side walls 41, 42 of the throttle chamber. The throttle chamber 6 and the runoff space 13 downstream therefrom can have all of the walls provided with slope as illustrated at 14.

In operation, the plates 11 are set to establish the desired value of $Q_{max}$ and water is admitted into the throttle shaft until the operation level S is attained, whereupon the floats 39, 40 close the inlet 4. The water drains at a constant rate past the shutter 8 and through the outlet 3, the throttle flap 4 opening to admit water at the same rate to maintain the operating level S. If the shutter 8 is opened more widely, the flow rate is increased, and to maintain the operating level S, the flap 4 will also open to a greater extent.

Figure 4:
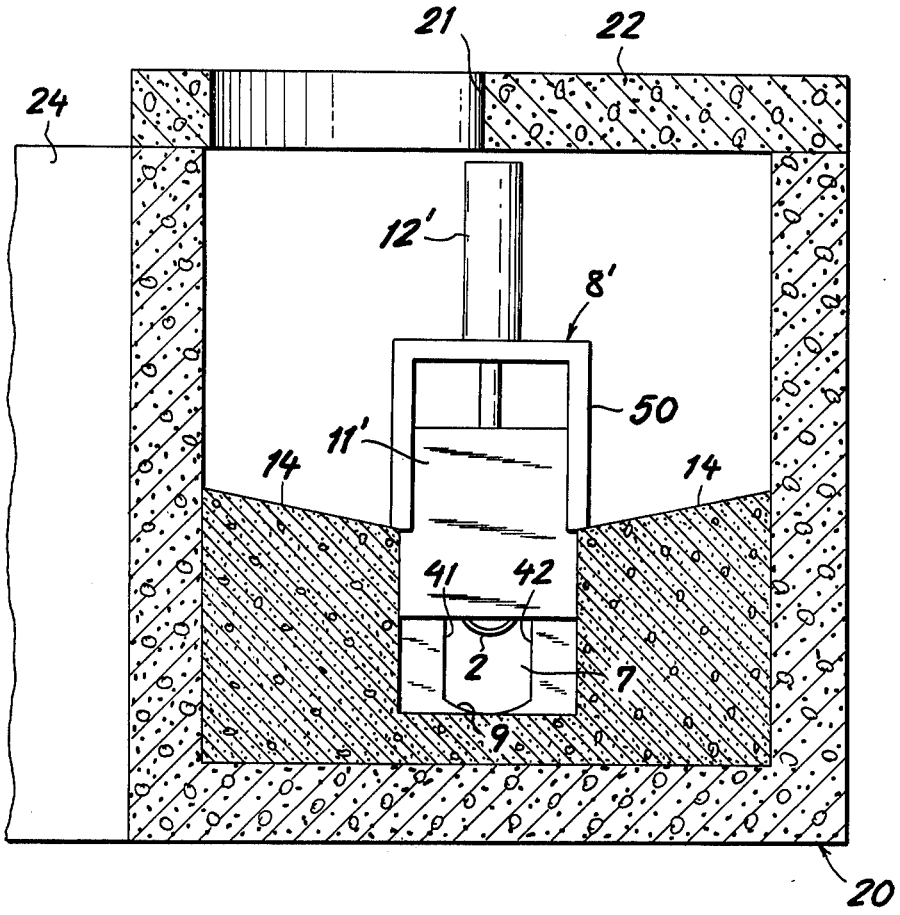
FIG. 4 is a section similar to FIG. 3 but illustrating another embodiment of the invention.

In FIG. 4 I have shown a system in which the shutter 8', which can be used in place of shutter 8, is a vertically displaceable plate 11' guided in a frame 50 and shiftable by the cylinder 12'.

I claim:

1. A throttle shaft for the control discharge of dammed-up water, especially waste water, comprising:

a housing formed with an inlet for said water and an outlet spaced from said inlet for the discharge of water from said housing;

a float-controlled throttle flap at said inlet for regulating the flow of liquid into said housing through said inlet to maintain a substantially constant operating water level in said housing;

means forming a throttle chamber in said housing between said throttle flap and said outlet, said throttle chamber having a waterflow passage communicating with said outlet; and a shutter in said housing along said waterflow passage and displaceable between fully open and fully closed positions to vary selectively the flow cross section of said passage, said throttle chamber converging in the direction of said outlet and having an apex at said passage, said shutter being disposed at said apex, said throttle chamber being formed with side walls of a height defining the maximum operating water level in said housing at which said throttle flap closes said inlet.

2. The throttle shaft defined in claim 1 wherein said throttle chamber is formed with a central discharge through sloping downwardly toward said outlet, said passage being provided between said shutter and said outlet with a runoff surface converging toward said outlet and having a greater slope than that of said channel.

3. The throttle shaft defined in claim 1 wherein said shutter has a height equal to that of said side walls.

4. The throttle shaft defined in claim 1 wherein said shutter comprises a pair of vertical blades displaceable horizontally toward and away from one another and forming a slit between them.

5. The throttle shaft defined in claim 1 wherein said shutter is a vertically displaceable plate.

6. The throttle shaft defined in claim 1 wherein said means forming said throttle chamber comprises a structure having surfaces sloping downwardly toward said passage.

* * * * *